US007761022B2

(12) United States Patent
Seo

(10) Patent No.: US 7,761,022 B2
(45) Date of Patent: Jul. 20, 2010

(54) IMAGE FORMING APPARATUS HAVING DELAYED POWER SUPPLY CUTOFF TIME WHEN COVER IS OPENED

(75) Inventor: In Chang Seo, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 170 days.

(21) Appl. No.: 12/025,964

(22) Filed: Feb. 5, 2008

(65) Prior Publication Data

US 2008/0199203 A1 Aug. 21, 2008

(30) Foreign Application Priority Data

Feb. 15, 2007 (KR) ..... 10-2007-0016017

(51) Int. Cl.
*G03G 15/00* (2006.01)

(52) U.S. Cl. ..... 399/88; 399/125

(58) Field of Classification Search ..... 399/88, 399/90, 37, 75, 125, 107
See application file for complete search history.

(56) References Cited

U.S. PATENT DOCUMENTS 6,885,835 B2 * 4/2005 Seo ..... 399/88
7,469,110 B2 * 12/2008 Nakazato et al. ..... 399/88
2007/0104495 A1 * 5/2007 You ..... 399/75 X
2008/0019709 A1 * 1/2008 Eom ..... 399/88 X
2008/0124094 A1 * 5/2008 Eom ..... 399/88 X

FOREIGN PATENT DOCUMENTS

JP 2006-030702 A * 2/2006

* cited by examiner

*Primary Examiner*—Sophia S Chen
(74) *Attorney, Agent, or Firm*—Staas & Halsey LLP

(57) ABSTRACT

An image forming apparatus including: a main body; a cover rotatably connected to the main body; a power-supply unit to generate a first power-supply voltage and a second power-supply voltage; an image forming engine to receive the first power-supply voltage from the power-supply unit; a control unit to receive the second power-supply voltage from the power-supply unit, and to stop an operation of the image forming engine, when the second power-supply voltage is cutoff. The image forming apparatus further includes a power-supply cutoff unit that delays a cutoff time of the first power-supply voltage, as compared to a cutoff time of the second power-supply voltage, according to an opening of the cover. The cutoff unit includes a first switch to cutoff first power-supply voltage to the image forming engine, and a second switch to cutoff the second power-supply voltage to control unit.

14 Claims, 5 Drawing Sheets

IMAGE FORMING APPARATUS HAVING DELAYED POWER SUPPLY CUTOFF TIME WHEN COVER IS OPENED

CROSS-REFERENCE TO RELATED APPLICATION

This application claims the benefit of Korean Application No. 2007-16017, filed on Feb. 15, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus to reduce accidents caused when a cover of the apparatus is opened.

2. Description of the Related Art

Generally, an image forming apparatus, for example, electrophotographic-type image forming apparatus, uses an electrophotographic printing scheme. The apparatus projects a laser beam onto a photoconductive drum, to form an electrostatic latent image, and converts the electrostatic latent image into a visible image, using a developer mounted to a developing apparatus. The visible image is transferred onto paper, and then fixed to the paper with heat and pressure. There are a variety of electrophotographic image forming apparatuses, for example, a laser beam printer (LBP), a duplicating machine, a facsimile, a multi-functional device, etc.

The image forming apparatus includes a power-supply unit to convert an AC power into a DC power, according to voltages of individual loads of an image forming engine. The image forming engine basically requires a low-voltage, power-supply voltage of about 24V, and a high-voltage, power-supply voltage of about 100 Kv. The power-supply unit provides a power-supply voltage of 5V to a control unit that controls the image forming operations.

If an after-sale (A/S) repairman or a user opens a cover rotatably connected to the front or lateral side of a main body of the apparatus, to inspect or maintain the image forming apparatus, the repairman or user may be in danger from a high voltage inside of the main body. For this purpose, the image forming apparatus includes a first switch and a second switch. If the cover is open, the first switch blocks the power-supply voltage of 5V from being applied from the power-supply unit to the control unit, and the second switch blocks the power-supply voltage of 24V from being applied from the power-supply unit to the image forming engine.

The first and second switches are simultaneously switched off, when the cover of the image forming apparatus is open, so that the power-supply voltages, applied to the control unit and the image forming engine, are blocked. As a result, the repairman or user can be protected from an electric shock.

However, while the cover is open, if the first and second switches are simultaneously switched off, and the power-supply voltages applied to the control unit and the image forming engine are simultaneously turned off, the image forming engine suddenly stops operation. This can result in the image forming apparatus being unstably powered off. For example, in the case of a developing process, if a high voltage for controlling a toner is not applied to the developing process of the image forming apparatus, the developing process stops operation. In this case, a developing roller of the developer does not immediately stop operation, but instead, continuously rotates by inertia, for a relatively long period of time. A carrier for carrying the toner and the toner are not controlled by the high voltage, so that the carrier and toner may leak out. The leaked carrier and toner pollutes inner parts of the image forming apparatus, such that the printing performance and the image quality may be seriously degraded. In addition, the fine structure of the surface of the photoconductive drum can be damaged, resulting in degraded printing performance, and a reduced lifetime of the apparatus. In addition, if the image forming apparatus suddenly stops operation, gears may be engage with each other, complicating the disassembly thereof. If the image forming apparatus suddenly stops operation, when paper is inserted under the roller, the paper may become jammed.

A representative image forming apparatus capable of solving the above-mentioned problems has been disclosed in Japanese Patent Laid-open No. 2006-030702, which is hereby incorporated by reference. The image forming apparatus disclosed in Japanese Patent Laid-open No. 2006-030702 includes a relay circuit as a delay circuit. The relay circuit allows a power-supply voltage, applied to an image forming engine, to be continuously applied to the image forming engine during a predetermined period of time, even though the cover is open. Therefore, the image forming apparatus allows the image forming engine to normally stop operation, and prevents the power-supply voltage from being applied to the image forming engine.

However, the above-mentioned conventional art disclosed in Japanese Patent Laid-open No. 2006-030702 requires the additional relay circuit, resulting in increased production costs circuit complexity.

SUMMARY OF THE INVENTION

Aspects of the invention to provide an image forming apparatus to delay a cutoff time of a power-supply voltage, applied to an image forming engine, when a cover is opened, without using a delay circuit, such as a relay circuit. This configuration results in lower production costs and simplified circuitry.

Aspects of the present invention relate to an image forming apparatus including: a main body; a cover rotatably connected to the main body; a power-supply unit to generate a first power-supply voltage and a second power-supply voltage; an image forming engine to receive the first power-supply voltage from the power-supply unit; a control unit to receive the second power-supply voltage from the power-supply unit, and to stop operation of the image forming engine when the second power-supply voltage is cutoff; and a power-supply cutoff unit to delay a cutoff time of the first power-supply voltage, as compared to a cutoff time of the second power-supply voltage, when the cover is opened.

In accordance with another aspect of the present invention, there is provided an image forming apparatus including: a main body; a cover rotatably connected to the main body; an image forming engine; a control unit to power off the image forming engine, if a power-supply voltage is cutoff; a power-supply unit to power on the image forming engine and the control unit; a first switching unit to power off the control unit, if the cover is partially opened; and a second switching unit to power off the image forming engine, if the cover is fully opened.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE EMBODIMENTS

Figure 1:
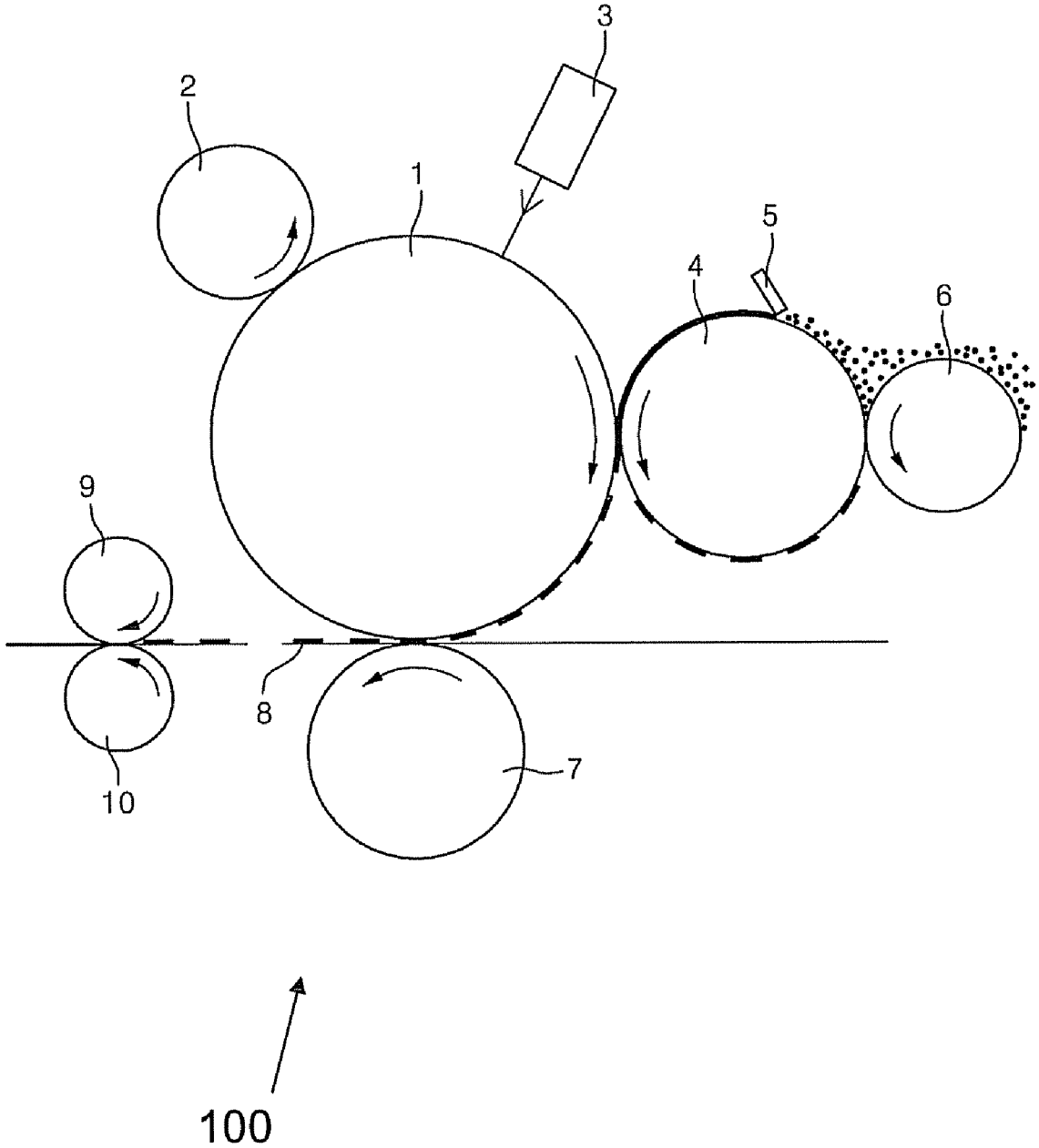
FIG. 1 is a conceptual diagram illustrating an image forming apparatus according to an exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below to explain the present invention, by referring to the figures.

FIG. 1 is a conceptual diagram illustrating an image forming apparatus 100, according to an exemplary embodiment of the present invention. Referring to FIG. 1, the image forming apparatus 100 includes an electric charger 2, a laser scanning unit (LSU) 3 acting as an exposure unit, a developer 4, a copy unit 7, and fusers 9 and 10. The surface of the photoconductive drum 1 is charged with electricity by the electric charger 2, and then the LSU 3 forms an electrostatic latent image on the photoconductive drum 1. The developer 4 develops the electrostatic latent image with toner, to form a visible image 8. The visible image 8 is transferred to a recording medium by the copy unit 7. The visible image 8 is fixed to the recording medium, by the fusers 9 and 10, and is then carried out to the outside.

Figure 2:
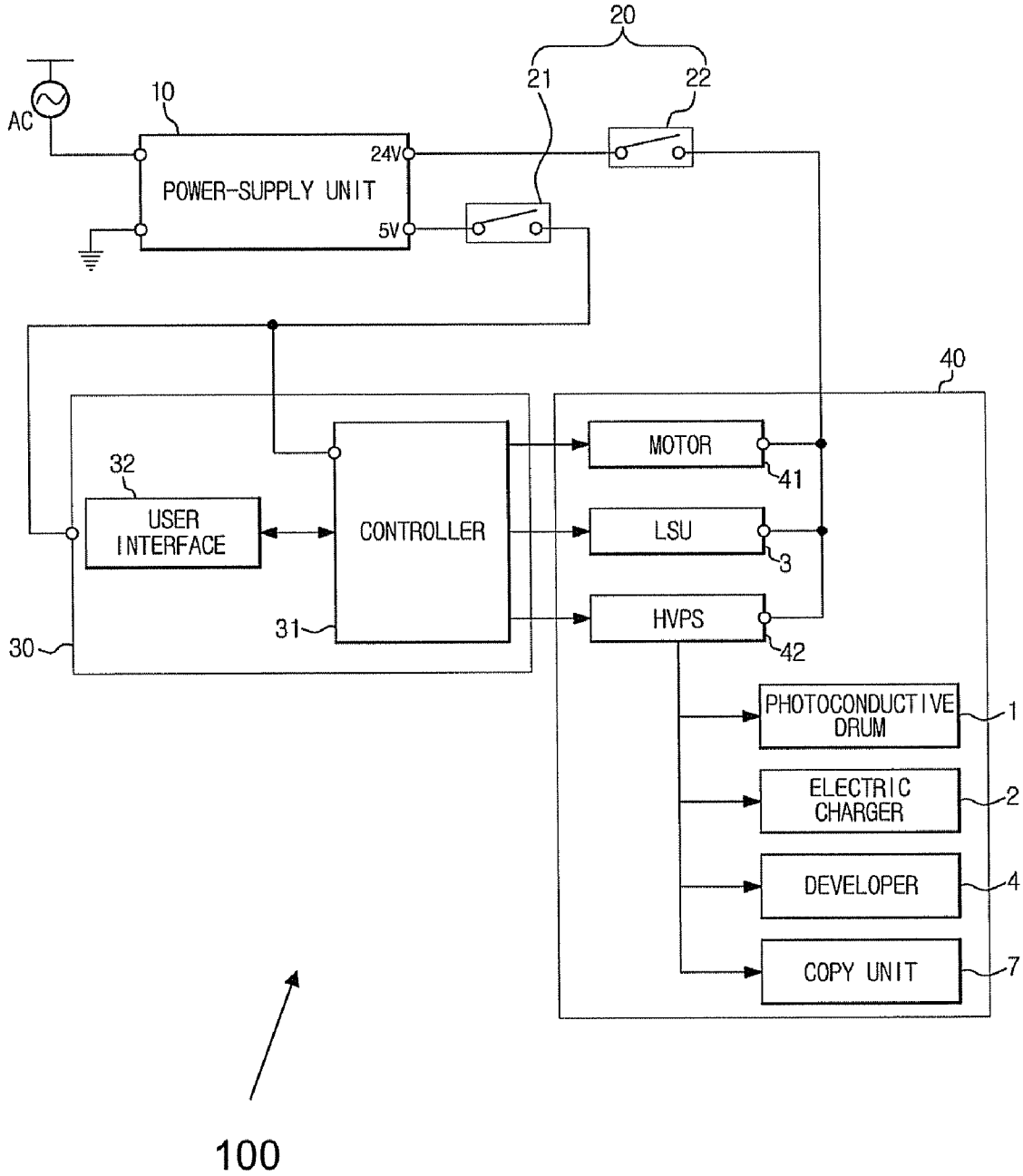
FIG. 2 is a block diagram illustrating an image forming apparatus, according to the exemplary embodiment of the present invention.

The image forming apparatus 100 can include a provider 6, and a regulation blade 5. A high voltage is applied to the photoconductive drum 1, the electric charger 2, the developer 4, and the copy unit 7, by a high voltage power supply (HVPS) 42, as shown in FIG. 2. The HVPS 42 generates the high voltage from a power-supply voltage (e.g., 24V) produced by a switching mode power supply (SMPS), and transmits the high voltage to the photoconductive drum 1, the electric charger 2, the developer 4, and the copy unit 7.

FIG. 2 is a block diagram illustrating the image forming apparatus 100. Referring to FIG. 2, the image forming apparatus 100 includes a power-supply unit 10, a power-supply cutoff unit 20, a control unit 30, and an image forming engine 40. The power-supply unit 10 is connected to an AC power source, converts the AC power into different power-supply voltages (e.g., 24V and 5V), and transmits the power-supply voltages of 24V and 5V to the control unit 30 and the image forming engine 40, respectively.

The image forming engine 40 includes a plurality of power-consumption loads, for example, a motor 41, the LSU 3, the HVPS 42, the photoconductive drum 1, an electric charger 2, the developer 4, the copy unit 7, etc. The motor 41, the LSU 3, and the HVPS 42 receive the power-supply voltage of 24V, from the power-supply unit 10. The photoconductive drum 1, the charger 2, the developer 4, and the copy unit 7 receive the high voltage generated by the HVPS 42. The motor 41 may be any one of a driving motor of the photoconductive drum, a toner alternating motor, and a fuser roller driving motor.

The control unit 30 receives the power-supply voltage of 5V from the power-supply unit 10. The control unit 30 can be powered by a different power-supply voltage (not shown). The control unit 30 includes a user interface 32 and a controller 31. The controller 31 is connected to the user interface 32, to allow a user to enter desired printing commands to form the image, and informs the user of the image forming information. The controller 31 can be connected to an external host computer (not shown), over a network, so that it receives image data from the host computer. Upon receiving the image data, the controller 31 analyzes the printing commands and the image data, and converts the analyzed data into a suitable format for use by the image forming engine 40.

The controller 31 controls the image forming engine 40 on the basis of the converted printing data, thereby controlling the image forming operation. Particularly, the controller 31 is connected to one side of a second switching unit 21, included in the power-supply cutoff unit 20, which is switched off when the cover is being opened. The controller 31 determines whether a cover (not shown) of the image forming apparatus 100 is open or closed, according to the ON or OFF status of the second switching unit 21. If the cover is being opened, the controller 31 performs control operations, to halt operations of the image forming engine 40.

The power-supply cutoff unit 20 includes a first switching unit 22 and the second switching unit 21. The first switching unit 22 is connected to a power-supply line extending between the power-supply unit 10 and the image forming engine 40. The first switching unit 22 blocks the power-supply voltage of 24V from being applied to the image forming engine 40. The second switching unit 21 is connected to a power-supply line extending between the power-supply unit 10 and the control unit 30. The second switching unit 21 blocks the power-supply voltage of 5V from being applied to the control unit 30.

Figure 3:
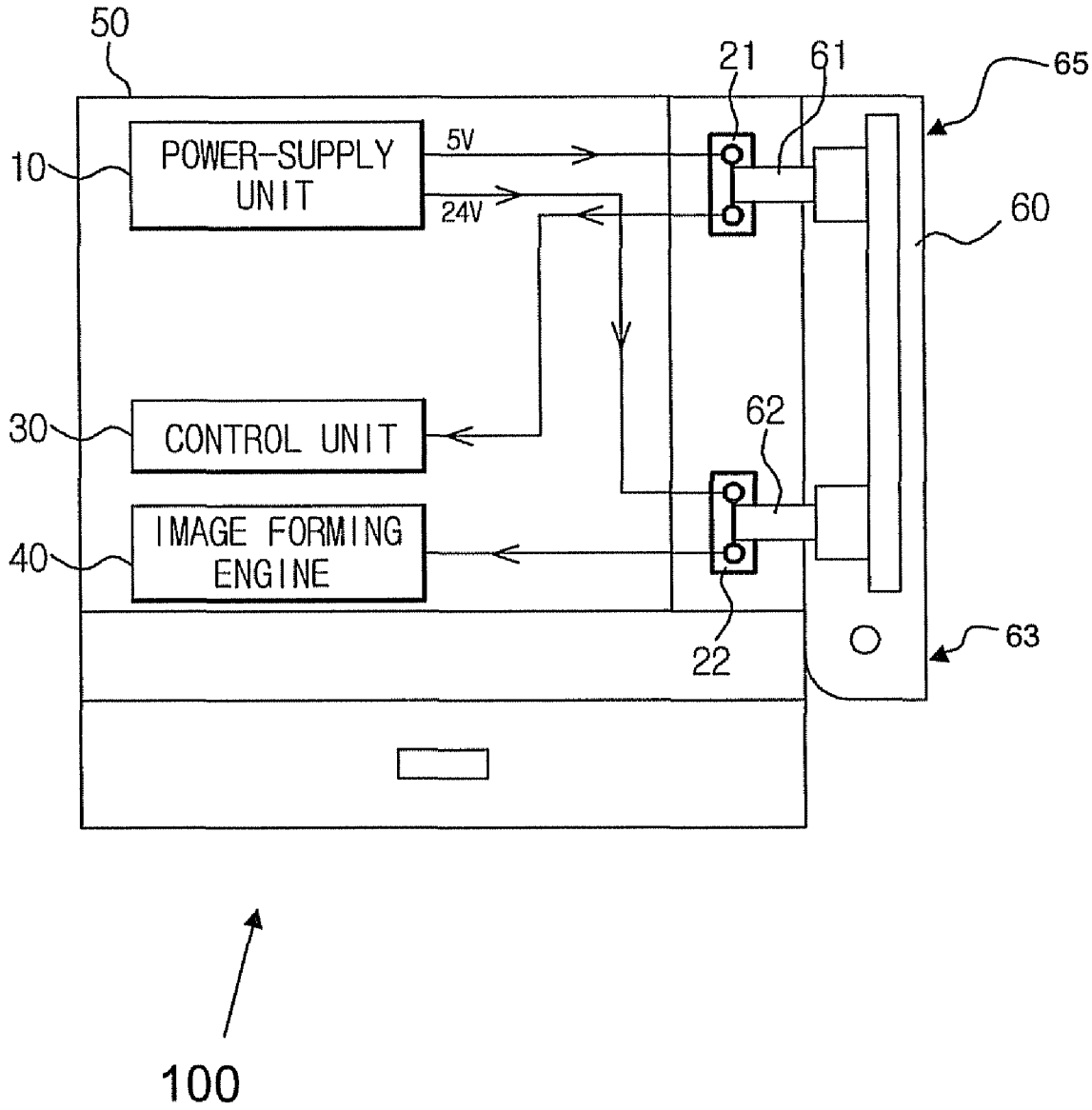
FIG. 3 shows the appearance of the image forming apparatus with a closed cover, according to aspects of the present invention.
Figure 4:
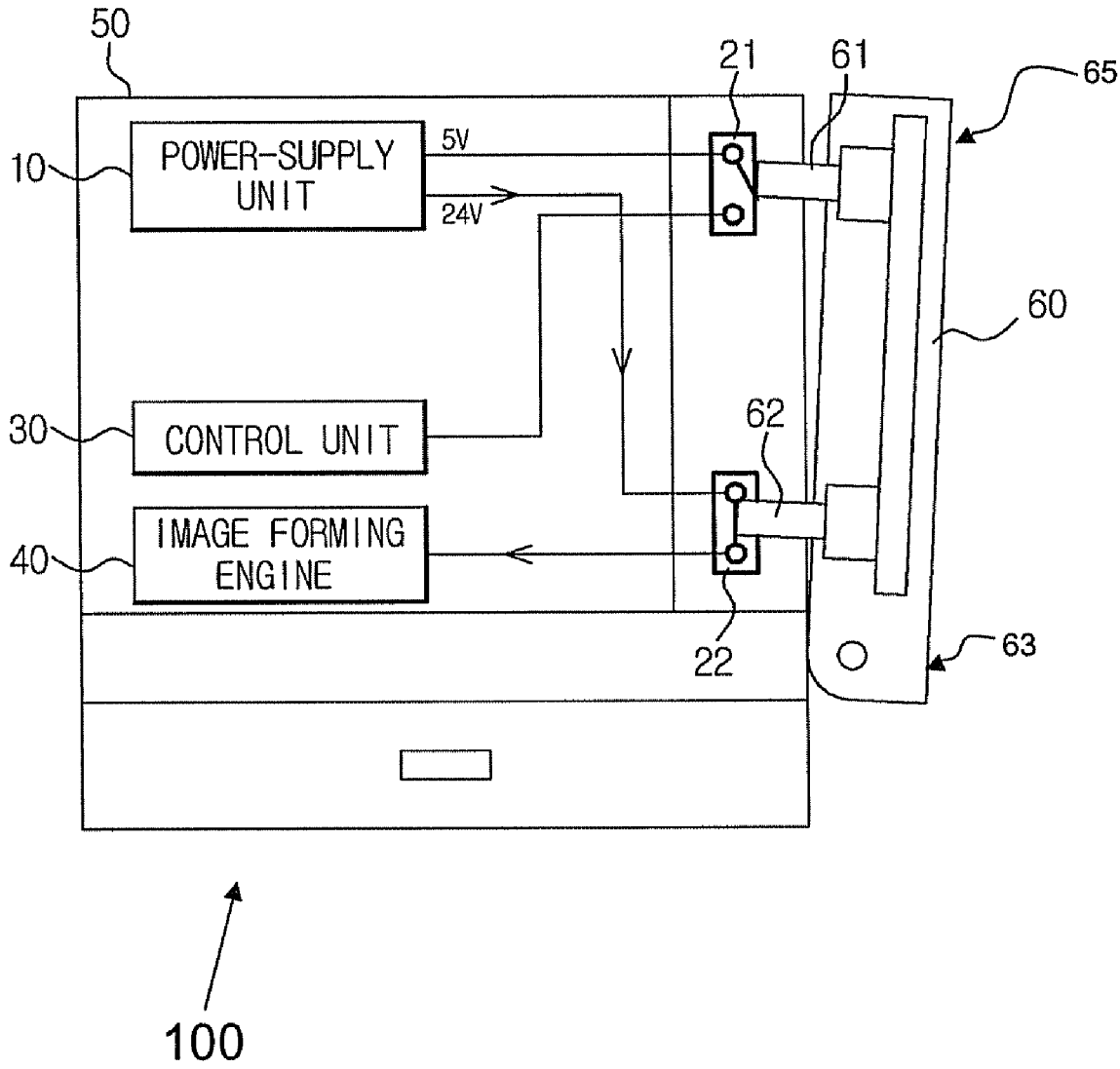
FIG. 4 shows the appearance of the image forming apparatus with a partially-opened cover, according to aspects of the present invention.
Figure 5:
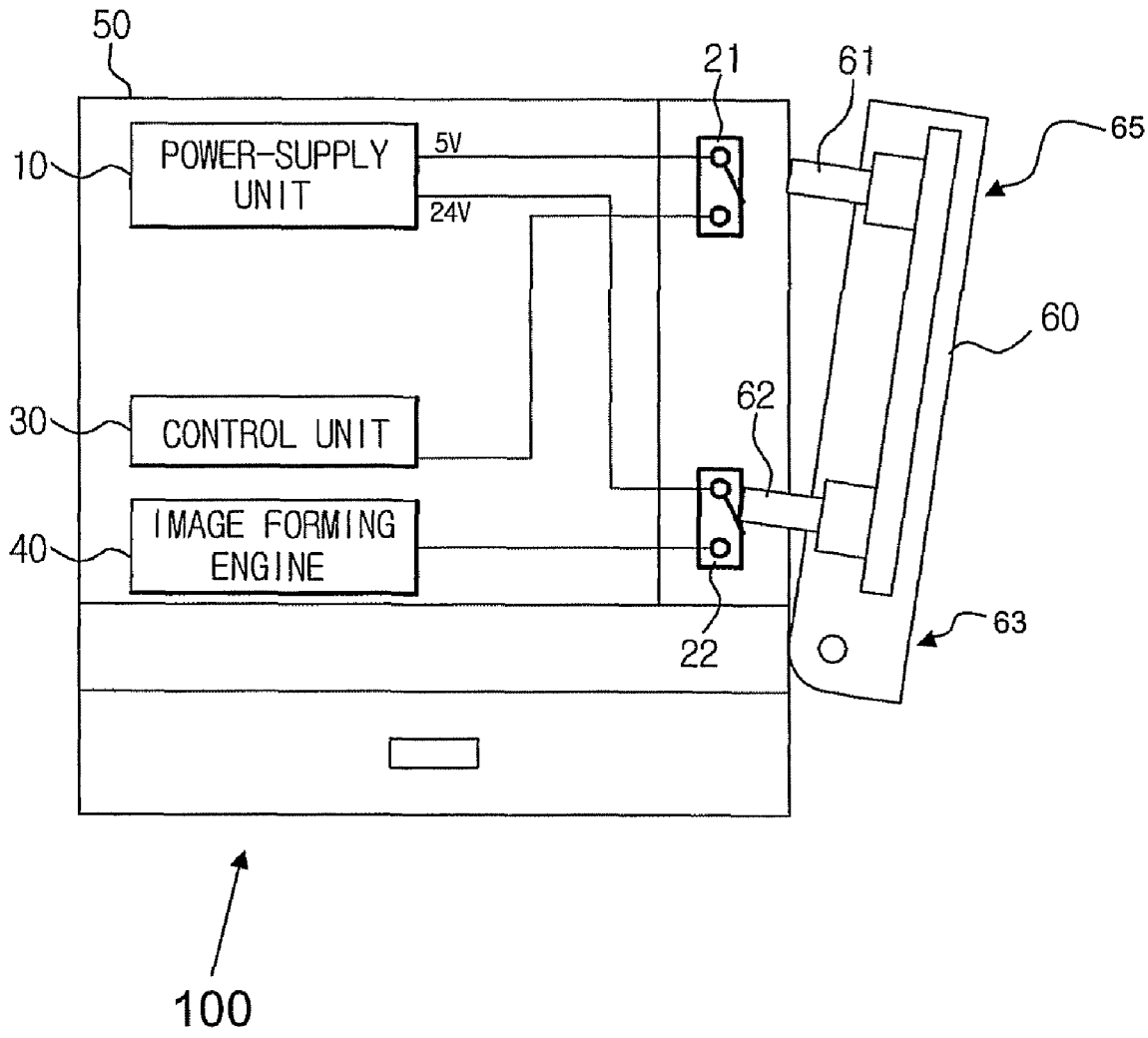
FIG. 5 shows the appearance of the image forming apparatus with a fully-opened cover, according to aspects of the present invention.

Referring to FIGS. 3 to 5, the image forming apparatus 100 includes a main body 50 and a cover 60 rotatably connected to the main body 50. The first switching unit 22 and the second switching unit 21 are designed to be switched on or off when brought into contact with the cover 60. In more detail, the first switching unit 22 and the second switching unit 21 are switched off when the cover 60 is open. When the cover 60 is being opened, the second switching unit 21 is switched off before the first switching unit 22 is switched off.

The first switching unit 22 is mounted to the main body 50, adjacent to a hinged end 63 of the cover 60. The second switching unit 21 is mounted to the main body 50, adjacent to a free end 65 of the cover 60. Therefore, if the cover 60 is partially open, only the second switching unit 21 is switched off. If the cover 60 is fully open, or open an amount that is greater than the partial amount that switches off the switching unit 21, the first and second switching units 22 and 21 are both switched off.

A first projection 62 and a second projection 61 extend from the cover 60. The first projection 62 contacts the first switching unit 22, when the cover 60 is closed, and disposed adjacent to the hinged end 63 of the cover 60. The second projection 61 contacts the second switching unit 21, when the cover 60 is closed, and is disposed adjacent to the free end 65 of the cover 60. Therefore, the first switching unit 22 is switched on or off by the first projection 62, and the second switching unit 21 is switched on or off by the second projection 61. In other words, if a contact point of the first switching unit 22 is physically brought into contact with the first projection 62, the first switching unit 22 is switched on. If the first projection 62 is released from the contact point, the first switching unit 22 is switched off. If the contact point of the second switching unit 21 is physically brought into contact with the second projection 61, the second switching unit 21 is switched on. If the second projection 62 is released from the contact point, the second switching unit 21 is switched off.

Therefore, the first and second switching units 22 and 21 are both switched off when the cover 60 is completely opened. While the cover 60 is being opened, the second switching unit 21 is switched off first. After a lapse of a predetermined time, the second switching unit 21 is switched off. As a result, the image forming apparatus 100 does not require a delay circuit, such as a relay circuit, used in the conventional art, and sequentially switches off the first and second switching units 22 and 21. In this way, production costs are reduced and the circuit is simplified.

In the operation of the first and second switching units 22 and 21, if the cover 60 is closed, as shown in FIG. 3, the first and second switching units 22 and 21 are both switched on. The power-supply unit 10 transmits the power-supply voltage of 5V to the control unit 30, via the second switching unit 21. At the same time, the power-supply voltage of 24V is generated by the power-supply unit 10, and is applied to the image forming engine 40, via the first switching unit 22.

As shown in FIG. 4, if an A/S repairman or a user partially opens the cover 60, the second switching unit 21 is switched off, while the first switching unit 22 remains on. Therefore, the second switching unit 21 blocks the power-supply voltage of 5V from being applied to the control unit 30. In this case, the controller 31 of the control unit 30 detects the above-mentioned situation, determines that the cover 60 is open, and controls the image forming engine 40 to perform a shut down operation, to avoid a sudden stoppage of the image forming engine 40.

As shown in FIG. 5, if the cover 60 is fully opened, the first switching unit 22 and the second switching unit 21 are both switched off, and the power-supply voltage of 24V is not applied to the image forming engine 40. Therefore, the image forming apparatus 100 prevents the occurrence of electric shocks, due to contact with the voltages of the inner components of the apparatus 100.

In other words, if the cover 60 is completely open, the image forming apparatus 100 is rendered interoperable, without using an additional delay circuit, and the first switching unit 22 and the second switching unit 21 are sequentially switched off. As a result, after the image forming engine 40 stably stops operation, the power-supply voltage of 24V, applied to the image forming engine 40, is cutoff. Therefore, the image forming apparatus 100 prevents the toner and the carrier from being leaked, due to an improper shutdown of image forming engine 40. The image forming apparatus 100 prevents a reduction of image quality, and reduces the degree of pollution inside of the main body 50. The image forming apparatus 100 does not stop operation with a printing medium inserted under the roller, so that the printing medium will not become jammed.

In brief, if the cover 60 of the main body 50 is opened during the image forming operation, the first and second switching units 22 and 21 are sequentially switched off, according to an interaction with the cover 60. As soon as the cover 50 is partially opened, the second switching unit 21 is switched off, so that the power-supply voltage of 5V is not applied to the control unit 30. The controller 31 detects the partial opening of the cover 60, and outputs a command to the image forming engine 40, to trigger a shutdown operation of the image forming engine 40. If the cover 60 is fully open, the first switching unit 22 is switched off, and the power-supply voltage of 24V is cutoff from the image forming engine 40. A delay between the switch off of second switching unit 21, and the switch off of the first switching unit 22, the image forming engine 40 stably stops operation, so that the image forming apparatus prevents the image forming engine 40 from being suddenly halted. The image forming engine 40 can stably stop operation by performing a shutdown operation. The shutdown operation prepares the image forming engine 40 for shutdown, and thereby prevents toner loss and/or damage to the image forming engine 40.

The method for preventing the power-supply voltage from being applied to the image forming engine 40, after the cover 60 is opened, will hereinafter be described in detail. If the cover 60 is partially opened, the contact between the second switching unit 21 and the second projection 61, mounted to the upper part of the cover 60, is broken, thereby switching off second switching unit 21. If the second switching unit 21 is switched off, the power-supply voltage of 5V is not applied to the control unit 30.

If the power-supply voltage of 5V is not applied to the control unit 30, the controller 31 detects that the cover 60 is partially opened, and generates a control command to stop the image forming engine 40. In this case, the first switching unit 22 continuously maintains the ON status, because the contact point is pressed by the first projection 62.

If the cover 60 is fully opened, or opened an amount that is greater than the partial amount that switches off the switching unit 21, the contact between the first switching unit 22 and the first projection 62 is broken, so that the first switching unit 22 is switched off. If the first switching unit 22 is switched off, the power-supply voltage of 24V is not applied to the load.

A predetermined time of about 200 msec elapses before the cover 60 is fully opened. The image forming engine 40 continues to be powered during the 200 msec. During this time, the image forming engine 40 can initiate the shutdown operation, such that it is properly shutdown. As a result, the image forming apparatus prevents the image forming engine 40 from being suddenly powered off, without using an additional delay circuit, such as a relay circuit. Therefore, the problems, caused by the abnormal power-supply cutoff of the image forming engine 40, can be prevented.

As is apparent from the above description, an image forming apparatus, according to aspects of the present invention, includes a first switch to power off an image forming engine, and a second switch to power off a control unit. The first and second switches are sequentially switched off, by the opening of a cover. The first and second switches are arranged to allow the power-supply voltage, applied to the image forming engine, to be cutoff after the power-supply voltage is cutoff from the control unit. If the power-supply voltage applied to the control unit is cutoff, the image forming engine stops operation, so that the image forming apparatus can delay a cutoff time of the power-supply voltage applied to the image forming engine, when the cover is opened, without using a delay circuit such as the relay circuit, so that the production costs are reduced and the circuit is simplified.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body;

a cover hinged to the main body;

a power-supply unit, to generate a first voltage and a second voltage;

an image forming engine, to receive the first voltage from the power-supply unit;

a control unit to receive the second voltage from the power-supply unit, and to stop an operation of the image forming engine when the second voltage is cutoff; and a power-supply cutoff unit to delay a cutoff time of the first voltage, as compared to a cutoff time of the second voltage, the power supply cut-off unit comprising:

a first switching unit to cutoff the first voltage; and a second switching unit to cutoff the second voltage, wherein, if the cover is fully open, a contact is broken between the first switching unit and the cover, such that the first switching unit is switched off, and if the cover is partially open, a contact is broken between the second switching unit and the cover, such that the second switching unit is switched off.

2. The image forming apparatus according to claim 1, wherein the first switching unit and the second switching unit cutoff the first voltage and the second voltage at different times, when the cover is being opened.

3. The image forming apparatus according to claim 2, wherein the first and second switching units are switched on when in contact with the cover.

4. The image forming apparatus according to claim 2, wherein the first switching unit is switched off after the second switching unit, when the cover is being opened.

5. The image forming apparatus according to claim 2, wherein the first and second switching units are disposed in the main body, adjacent to the cover.

6. The image forming apparatus according to claim 5, further comprising:

a first projection disposed adjacent to a hinged end of the cover; and a second projection disposed adjacent to a free end of the cover, wherein, if the cover is fully open, a contact is broken between the first switching unit and the first projection, such that the first switching unit is switched off, and if the cover is partially open, a contact is broken between the second switching unit and the second projection, such that the second switching unit is switched off.

7. An image forming apparatus including and, comprising:

a main body;

a cover rotatably connected to the main body;

an image forming engine;

a control unit to power off the image forming engine, if a voltage is cutoff;

a power-supply unit to power on the image forming engine and the control unit;

a first switching unit to power off the image forming engine; and a second switching unit to power off the control unit, wherein, if the cover is fully open, a contact is broken between the first switching unit and the cover, such that the first switching unit is switched off, and if the cover is partially open, a contact is broken between the second switching unit and the cover, such that the second switching unit is switched off.

8. The image forming apparatus according to claim 7, wherein the first and second switching units are disposed in the main body adjacent to the cover.

9. The image forming apparatus according to claim 8, further comprising:

a first projection disposed adjacent to a hinged end of the cover; and a second projection disposed adjacent to a free end of the cover, wherein, if the cover is fully open, a contact is broken between the first switching unit and the first projection, such that the first switching unit is switched off, and if the cover is partially open, a contact between the second switching unit and the second projection, such that the second switching unit is switched off.

10. An image forming apparatus comprising:

a main body;

a cover hinged to the main body;

a power-supply unit, to generate a first voltage and a second voltage;

an image forming engine, to receive the first voltage from the power-supply unit;

a control unit to receive the second voltage from the power-supply unit, and to stop an operation of the image forming engine, when the second voltage is blocked;

a first switching unit disposed adjacent to a hinged end of the cover, to cutoff the first voltage; and a second switching unit disposed adjacent to a free end of the cover, to cutoff the second voltage, wherein the second switching unit cuts off the second voltage before the first switching unit cuts off the first voltage, when the cover is being opened.

11. The image forming apparatus according to claim 10, further comprising:

a first projection extending from the cover, to selectively contact the first switching unit, such that the first voltage flows through the first switching unit, when the cover is closed, and the first switching unit cuts off the first voltage when the cover is fully opened; and a second projection extending from the cover, to selectively contact the second switching unit, such that the second voltage flows through the second switching unit, when the cover is closed, and the second switching unit cuts off the second voltage, when the cover is partially opened.

12. The image forming apparatus according to claim 10, wherein when the cover is being opened, the second switching unit cuts off the second voltage for about 200 ms, before the first switching unit cuts off the first voltage.

13. The image forming apparatus according to claim 10, wherein the control unit stops the operation of the image forming engine before the first voltage is cutoff.

14. The image forming apparatus according to claim 10, wherein the control unit controls the image forming engine to perform a shutdown operation before the first voltage is cutoff by the first switching unit.

* * * * *